United States Patent [19]

Jens

[11] 4,393,511

[45] Jul. 12, 1983

[54] OUTER ROTATION BEARING FOR X-RAY TUBE

[75] Inventor: Richard A. Jens, Milwaukee, Wis.

[73] Assignee: General Electric Company, Schenectady, N.Y.

[21] Appl. No.: 335,909

[22] Filed: Dec. 30, 1981

[51] Int. Cl.[3] ..... H01J 35/10

[52] U.S. Cl. ..... 378/128; 378/132

[58] Field of Search ..... 378/128, 132

[56] References Cited

U.S. PATENT DOCUMENTS 2,121,632 6/1938 Gross et al. ..... 378/128

2,230,858 2/1941 Atlee ..... 378/132

FOREIGN PATENT DOCUMENTS 1041173 10/1958 Fed. Rep. of Germany ..... 378/128

*Primary Examiner*—Alfred E. Smith

*Assistant Examiner*—T. N. Grigsby

*Attorney, Agent, or Firm*—Wheeler, House, Fuller & Hohenfeldt

[57] ABSTRACT

An improved rotating anode x-ray tube having front and rear bearings supporting a tubular member attached to the rotating anode for rotation about a stationary stem member. The front bearing is modified by providing clearance between its retainer and the tubular member to reduce the amount of heat conducted through the bearing. The rear bearing is conventional, and thus has good electrical and thermal conductivity. As a result, heat conducted from the anode to the tubular member is preferentially directed to the stem member through the rear bearing, rather than through the front bearing. The front bearing, normally the hotter of the two, thus remains cooler, increasing its life substantially.

4 Claims, 4 Drawing Figures

OUTER ROTATION BEARING FOR X-RAY TUBE

BACKGROUND OF THE INVENTION

This invention relates to rotating anode x-ray tubes. In known devices the rotor assembly is commonly supported by a pair of axially spaced apart self lubricating ball bearings having inner races fixed to the rotor shaft and outer races fixed to a stationary tubular stem. Such a structure is shown in U.S. Pat. No. 4,272,696, issued to the present inventor and others on June 9, 1981 and owned in common with the present invention. A major cause of bearing failure in such x-ray tubes (particularly for the front bearing, which is nearest the rotating anode) is the great amount of heat conducted through the bearings; the bearings cannot tolerate a temperature greater than about 500 degrees Celsius during tube operation. Tube operating times are thus limited by the need to prevent the bearings from failing as a result of exceeding their operating temperatures.

SUMMARY OF THE INVENTION

The primary object of the present invention is to overcome the problems just noted.

The invention is a rotating anode x-ray tube including an air impervious envelope, a stationary stem member passing through a wall of the envelope and extending axially within it; a rotatable tubular member coaxial with and disposed around the stem member and supporting the x-ray target anode; and front and rear bearings between the stem and tubular member. The front bearing is isolated from the tubular member to reduce the rate of transmission of heat through the bearing, and the rear bearing more readily conducts heat but is located further than the front bearing from the source of heat.

In the preferred and illustrated embodiment of the invention, the front bearing is isolated by interposing between its outer race and the tubular member a bearing retainer which is nonrotatably secured to the tubular member with clearance between them, thus reducing the thermal conductivity from the tubular member to the bearing.

Heat is preferentially transmitted from the anode to the stem member via the tubular member and rear bearing, instead of through the front bearing. The x-ray tube can thus be used longer before the temperature of either bearing exceeds its operable limit.

DESCRIPTION OF THE PREFERRED EMCODIMENT

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Figure 1:
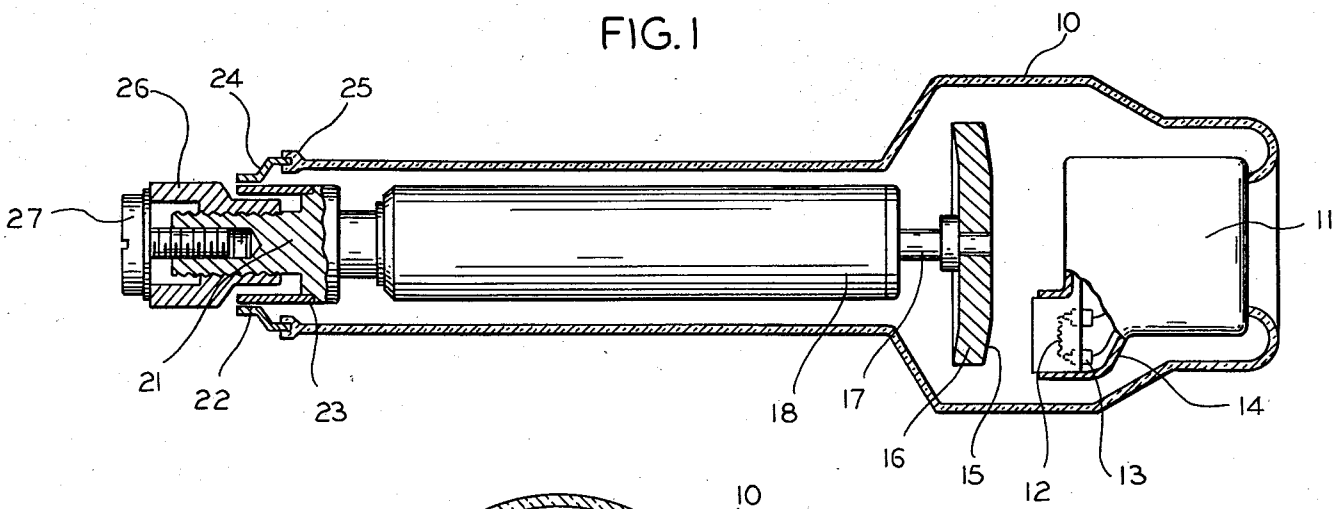
FIG. 1 is a longitudinal sectional view of a rotating anode x-ray tube which embodies the invention and which has some parts broken away to reveal other parts.
Figure 3:
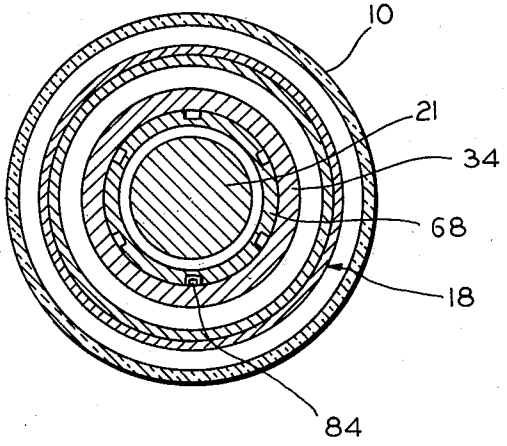
FIG. 3 is a transverse section taken on a line corresponding with 3—3 in FIG. 2.

FIG. 1 shows the conventional parts of a rotating anode x-ray tube in which the new bearing arrangement may be employed. The x-ray tube comprises a glass envelope 10 which, at one end, has a cathode support 11 sealed into it. A filament or cathode 12 is mounted on insulators 13 and located in a focusing cup 14 which focuses an electron beam against the beveled annular focal track area 15 of the rotating x-ray target 16. Target 16 is supported on a stud 17 which extends from a rotor assembly generally designated by the reference numeral 18. This is a traditional rotor in which a magnetic field is induced to cause it to rotate. The induction coils for producing the field are not shown. The rotor comprises an outer sleeve 19 of copper laminated to an inner sleeve 20 of ferrous metal.

Figure 2:
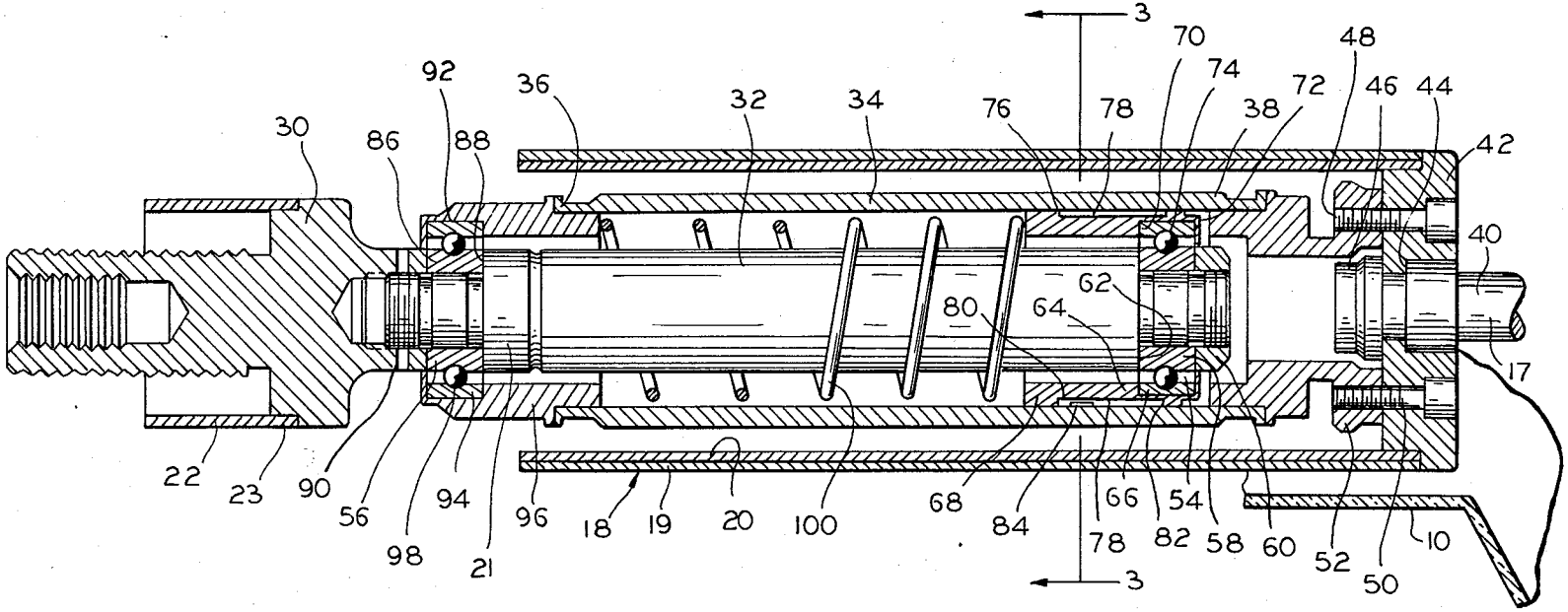
FIG. 2 is an enlarged longitudinal section of the anode assembly isolated from the x-ray tube shown in FIG. 1.

As will be more evident later when FIG. 2 is discussed, the rotor is rotatable on a stem 21. The stem has a tube 22 brazed to it in the region marked 23. The other end of metal tube 22 is welded to a ferrule 24 which is sealed into the end 25 of tube envelope 10. Stem 21 has a collet 26 screwed or brazed onto it and a screw 27 is received in the end of the stem for supporting the tube in its casing and for making an electrical connection to it.

Referring now to FIG. 2, stem 21 has a first part 30 outside envelope 10 for receiving an external electrical connection and a second part 32 extending axially into envelope 10 and stationary with respect to the envelope. Stem 21 receives a coaxial rotatable tubular member 34 having first and second axially separated parts 36 and 38 each disposed about second part 32 of stem 21. The first end 40 of stud 17 is mounted to a cap 42; shoulder 44 of stud 17 and nut 46 threaded on first end 40 secure stud 17 to cap 42. In turn, cap 42 is attached by screws such as 48 and 50 to bearing hub 52 which is welded to second part 38. As a result, anode 16, stud 17, cap 42, bearing hub 52, and tubular member 34 are secured together as a unitary assembly for being rotated by rotor 18 which depends from cap 42.

The tubular member 34 is mounted on second part 32 of stem 21 by axially spaced front and rear bearings 54 and 56; front bearing 54 is much closer to anode 16, the source of objectionable heat. Front bearing 54 has a first bearing portion or inner race 58 fixed to second part 32 of stem 21 by a nut 60 threaded on second part 32 and urging inner race 58 against a shoulder 62 formed in stem 21. Second bearing portion 64 of the front bearing comprises an outer race 66 and a front bearing retainer sleeve 68 having an internal shoulder 70 against which outer race 66 is captured within sleeve 68 by swaging the rim 72 of sleeve 68 inwardly. First ball means 74, here a ring of spherical balls, but possibly rollers or other internal elements, is confined between inner and outer races 58 and 66 so that each ball is kept in contact with each race.

Front bearing retainer sleeve 68 has a cylindrical outer wall 76 interrupted by flutes 78 having first and second axial ends 80 and 82 which are near the axial ends of the sleeve to reduce the contact area between retainer sleeve 68 and second part 38 of member 34. Clearance, in this instance at least about 0.003 inches (0.08 millimeters), is provided between sleeve 68 and tubular member 34 to reduce the thermal conductivity across the interface between them. As a result, the amount of heat transmitted to front bearing 54 during operation of the x-ray tube is substantially reduced. Retainer sleeve 68 is keyed to tubular member 34 by a pin 84 extending inwardly from tubular member 34 and received in a flute 78.

Rear bearing 56 comprises a third bearing portion 86 or inner race maintained against shoulder 88 of second part 32 of stem 21 by stem first part 30 threaded to the end 88 of second part 32 of stem 21. Rear bearing 56 also includes a fourth bearing portion 92 comprising an outer race 94 secured within a rear bearing race retainer sleeve 96 in the same manner that outer race 66 is secured within front bearing retainer sleeve 68. Retainer sleeve 96 and first part 36 of tubular member 34 are welded together, and thus rigidly secured to each other. Second ball means 98 are captured between the inner and outer races of rear bearing 56 and are in good thermal and electrical contact with the inner and outer races.

To assist in maintaining the thermal and electrical contact between the balls and the respective bearing races, a compression spring 100 is captured between the front and rear retainer sleeves 68 and 96 for urging pin 84 against first end 80 uniformly despite temperature variations in the device as it is used. When pin 84 rests against wall 80, the front retainer sleeve 68 is at its second axial limit of travel.

Due to the clearance and fluting between retainer sleeve 68 and tubular member 34, contrasted with the lack of clearance between rear retainer sleeve 96 and tubular member 34 to which it is welded, heat generated at anode 16 and conducted through stud 17, cap 42, bearing hub 52, and tubular member 34 is preferentially conducted to second part 32 of stem 21 via rear retainer sleeve 96, outer race 94, second ball means 98, and inner race 86.

EXAMPLE 1

Two anode and stem assemblies were built, one according to the present invention and the other a prior art structure as shown in U.S. Pat. No. 4,272,696, hereby incorporated by reference as part of the present disclosure. Similar parts were made of the same materials and were similarly sized. The bearings in each assembly were frozen and a thermocouple was inserted through each tubular member and mounted adjacent the front bearing.

Figure 4:
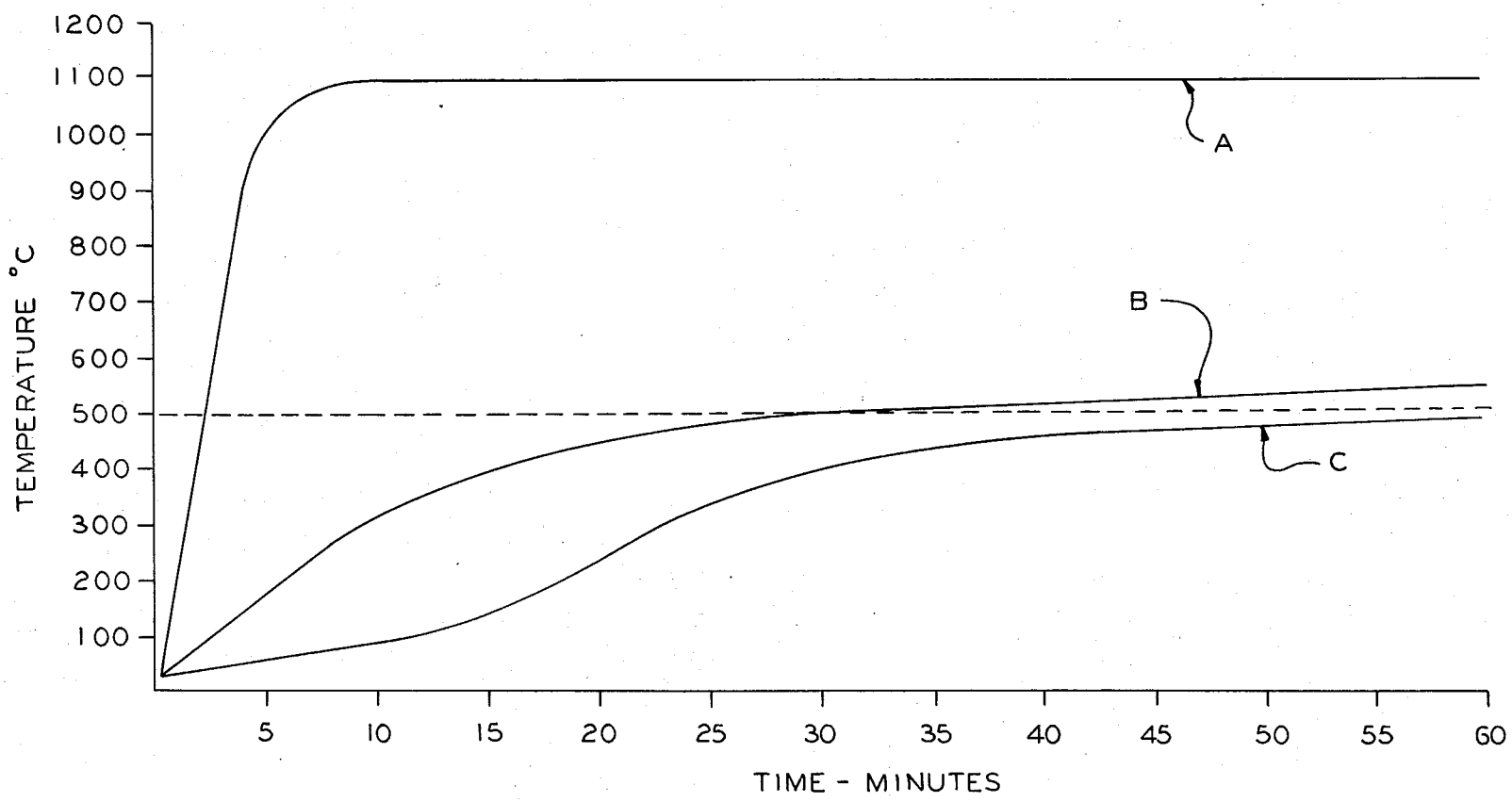
FIG. 4 is a plot of temperature versus time, further explained in Example 1 below; curve A is anode temperature, curve B is the front bearing temperature for a prior art anode assembly, and curve C is the front bearing temperature of an anode assembly made according to the present invention.

The anode of each assembly was bombarded with electrons at a power level of about 2.5 kilowatts to raise its temperature to 1100 degrees Celsius, and its temperature was then maintained during the test. The temperature of each front bearing was plotted as a function of time. The results are recorded in FIG. 4, in which curve A is the anode temperature, curve B is the front bearing temperature of the assembly made according to the incorporated patent, and curve C is the front bearing temperature of the assembly made according to the present invention.

The front bearing of the assembly made according to the present invention remained cooler throughout the test. Further, the front bearing temperature in the prior art structure exceeded 500 degrees Celsius—roughly the highest temperature at which the bearing can function—about 32 minutes after the test began. The front bearing in the assembly made according to the present invention never attained a temperature as high as 500 degrees during the one hour test.

EXAMPLE 2

An anode assembly built according to the present invention was installed in a bearing tester in which the rotor was turned constantly at 10,000 RPM while the target was maintained at 900 degrees Celsius by electron bombardment. These conditions were maintained for twenty hours. After the test the front and rear bearings in the present structure were examined and found to be sound.

I claim:

1. A rotating anode x-ray tube, comprising:

an envelope;

a stationary stem member passing through a wall of said envelope and having a first part outside said envelope for receiving an external electrical connection and a second part extending exially into said envelope;

a rotatable tubular member within said envelope and coaxial with said stem member second part, said tubular member having first and second axially separated parts disposed about the second part of said stem member;

an x-ray target anode supported by an axially disposed stud having a first end fixed to said tubular member second part and a second end fixed to said anode;

rotor means for rotating said anode;

a front bearing for rotatably supporting the second part of said tubular member on said stem member second part while resisting conduction of heat between them, comprising a first bearing portion fixed to said stem member second part, a second bearing portion nonrotatably fixed within said tubular member second part with clearance between them to reduce thermal conduction, and first ball means between said first and second bearing portions; and a rear bearing separated from said rotor assembly by said front bearing for rotatably supporting the first part of said tubular member on said stem member second part, comprising a third bearing portion fixed to said stem member second part, a fourth bearing portion fixed within said tubular member first part, and second ball means between said third and fourth bearing portions, with good thermal and electrical contact from said tubular member, via said fourth bearing portion, second ball means, and third bearing portion, to said stem member second part;

whereby heat from said target anode is preferentially conducted between said tubular member and said stem via said rear bearing.

2. The x-ray tube of claim 1, wherein said first bearing portion comprises an outer bearing race and a front bearing race retainer sleeve having an outer wall keyed to said tubular member and an inner wall secured to said outer bearing race.

3. The x-ray tube of claim 2, wherein said third bearing portion comprises an outer bearing race and a rear bearing race retainer sleeve having an outer wall secured to said tubular member with substantially no clearance between them and an inner wall secured to said outer bearing race with substantially no clearance between them.

4. The x-ray tube of claim 3, wherein said front bearing race retainer sleeve is slidably secured in said tubular member between first and second axial limits of travel, the second axial limit being further from said rear bearing, and further comprising spring means disposed between said front and rear retainer sleeves for urging said front bearing first portion to its second axial limit of travel, whereby to provide thermal strain relief between said stem member and tubular member.

* * * * *